US012369674B2

(12) United States Patent
Woods

(10) Patent No.: US 12,369,674 B2
(45) Date of Patent: Jul. 29, 2025

(54) INDUSTRIAL SHOE PROTECTOR

(71) Applicant: Jeffrey N. Woods, Portland, OR (US)

(72) Inventor: Jeffrey N. Woods, Portland, OR (US)

( * ) Notice: Subject to any disclaimer, the term of this patent is extended or adjusted under 35 U.S.C. 154(b) by 0 days.

(21) Appl. No.: 13/632,757

(22) Filed: Oct. 1, 2012

(65) Prior Publication Data

US 2013/0081308 A1 Apr. 4, 2013

Related U.S. Application Data

(60) Provisional application No. 61/541,669, filed on Sep. 30, 2011.

(51) Int. Cl.
*A43B 3/16* (2022.01)
*A43B 7/32* (2006.01)

(52) U.S. Cl.
CPC ..... *A43B 3/163* (2013.01); *A43B 7/32* (2013.01)

(58) Field of Classification Search
CPC ..... A43B 1/00; A43B 3/00; A43B 3/0031; A43B 3/16; A43B 3/18; A43B 5/0419; A43B 7/08; A43B 23/02; A43B 23/24; A43B 23/26; A43B 3/0026; A43B 5/18; A43B 5/185; A43B 11/00; A43B 23/28; A41D 17/00; A43C 7/00; A43C 7/02; A43C 7/04
USPC ..... 36/72 R, 132, 136, 3 A, 7.1 R, 53, 54
See application file for complete search history.

(56) References Cited

U.S. PATENT DOCUMENTS 3,006,086 A * 10/1961 Bird, Jr. ..... A43C 13/14 36/72 R
3,068,593 A * 12/1962 O'Donnell ..... A43C 13/14 36/72 R
3,175,292 A * 3/1965 MacQuaid ..... A43B 7/32 36/72 R
3,271,888 A * 9/1966 Graham ..... A43C 13/14 36/72 R
3,334,427 A * 8/1967 Edwards ..... A43B 23/26 36/72 R
3,470,630 A * 10/1969 Ott ..... A43C 13/14 36/72 R
3,518,781 A * 7/1970 De Vita ..... A43C 13/14 36/72 R
4,231,170 A * 11/1980 Griswold ..... A43B 3/16 36/72 R
4,333,248 A * 6/1982 Samuels ..... A43B 3/18 36/101
4,536,975 A * 8/1985 Harrell ..... A43B 1/0072 2/245

(Continued)

*Primary Examiner* — Megan E Lynch
(74) *Attorney, Agent, or Firm* — Rylander & Associates, PC; Philip R. M. Hunt

(57) ABSTRACT

An industrial shoe protector includes a tongue portion, and a canopy lace and canopy portion connected to said tongue portion. The industrial shoe protector protects laces and stitching of an industrial shoe from sparks caused by welding, high speed cutting and other similar activities. The canopy portion has two lace securing slits. The industrial shoe protector is configured to secure to an industrial shoe by inserting laces of the industrial shoe through the slits in the canopy portion with the tongue portion deposed behind the laces above an ankle of the industrial shoe. The canopy portion is configured to cover the laces of the industrial shoe below the ankle of the industrial shoe when the industrial shoe protector is secured to the industrial shoe.

16 Claims, 3 Drawing Sheets

(56) References Cited

U.S. PATENT DOCUMENTS 4,823,426 A * 4/1989 Bragga ..... A47L 23/00 15/210.1
4,949,437 A * 8/1990 Anderson ..... A43C 7/02 24/712.2
D311,446 S * 10/1990 Merritt ..... D2/975
5,042,119 A * 8/1991 Williams ..... A43B 3/0031 24/442
5,094,016 A * 3/1992 DiVito ..... A43B 1/0036 36/1
5,209,000 A * 5/1993 Rowland ..... A43B 1/0072 2/245
5,251,386 A * 10/1993 Diaz ..... A41D 17/00 36/1.5
5,311,679 A * 5/1994 Birch, Sr. ..... A43B 3/0031 2/919
5,313,719 A * 5/1994 Koethe ..... A43C 13/14 36/136
5,421,106 A * 6/1995 Emrick ..... A43B 3/0031 36/136
5,459,947 A * 10/1995 Lasher ..... A43B 23/26 24/306
5,711,092 A * 1/1998 Despres ..... A43C 13/14 36/133
D389,989 S * 2/1998 Pilz ..... A43B 3/0078 D2/909
5,778,500 A * 7/1998 Illingworth ..... A43C 7/00 24/712
5,845,422 A * 12/1998 Valteau, III ..... A43B 3/0078 36/136
6,000,111 A * 12/1999 Deskins ..... A43C 7/02 24/442
6,128,801 A * 10/2000 Adzick ..... A43B 1/0081 15/210.1
6,224,524 B1 * 5/2001 Singh ..... A43B 5/18 36/136
6,684,543 B2 * 2/2004 Fernau ..... A43B 3/0078 24/3.2
7,165,342 B2 * 1/2007 Sheen ..... A41D 13/06 36/114
7,640,640 B1 * 1/2010 Watkins ..... A43C 7/02 24/712.3
7,726,045 B2 * 6/2010 Riebesell ..... A43B 3/06 36/100
8,438,708 B1 * 5/2013 Tuck ..... A43C 7/005 24/712.3
2002/0029496 A1 * 3/2002 Morle ..... A43B 5/02 36/99
2003/0196351 A1 * 10/2003 Hipp ..... A43B 5/18 36/72 R
2004/0163285 A1 * 8/2004 Johnson ..... A43B 1/0081 36/136
2004/0250445 A1 * 12/2004 Pritchett ..... A43B 3/16 36/2.6
2005/0022427 A1 * 2/2005 Kerns ..... A43B 5/14 36/50.1
2005/0183288 A1 * 8/2005 Hull ..... A43B 3/0078 36/54
2005/0198866 A1 * 9/2005 Wiper ..... A43B 5/14 36/50.1
2005/0252042 A1 * 11/2005 Harrington ..... A43B 5/00 36/132
2005/0257404 A1 * 11/2005 Daza ..... A43B 7/32 36/72 R
2005/0268493 A1 * 12/2005 Foxen ..... A43B 3/24 36/89
2007/0089322 A1 * 4/2007 Rooney ..... A43B 1/0054 36/136
2008/0078104 A1 * 4/2008 Riebesell ..... A43B 1/0027 36/54
2008/0110058 A1 * 5/2008 Shepherd ..... A43B 23/26 36/114
2009/0031585 A1 * 2/2009 Shepherd ..... A43B 23/26 36/89
2010/0192337 A1 * 8/2010 LaPlante ..... A43B 3/0078 24/712
2010/0228172 A1 * 9/2010 Biddinger ..... A61F 5/0195 602/30
2011/0247240 A1 * 10/2011 Eder ..... A43B 1/0009 36/133
2012/0124864 A1 * 5/2012 Aveni ..... A43B 23/0215 36/54

* cited by examiner

INDUSTRIAL SHOE PROTECTOR

CROSS-REFERENCE TO RELATED APPLICATION

This application is a non-provisional of and claims priority to U.S. Provisional Patent Application Ser. No. 61/541,669 filed 30 Sep. 2011, herein incorporated by reference.

FIELD OF THE INVENTION

The present invention relates to industrial safety. More particularly, the present invention relates to protection of a worker's feet and shoes from sparks from cutting and welding.

BACKGROUND

Industrial manufacturing is often a hazardous work environment. Welders and cutters frequently are showered with sparks in the course of their occupation. In addition to posing a risk on the worker, which can be mitigate by proper clothing, the shower of sparks from these occupations damage the worker's footwear, significantly reducing the life span of the heavy duty, expensive shoes that are used.

SUMMARY AND ADVANTAGES

An industrial shoe protector protects laces and stitching of an industrial shoe from sparks caused by welding, high speed cutting and other similar activities. The industrial shoe protector includes a tongue portion, and a canopy lace and canopy portion connected to said tongue portion. The canopy portion has two lace securing slits. The industrial shoe protector is configured to secure to an industrial shoe by inserting laces of the industrial shoe through the slits in the canopy portion with the tongue portion deposed behind the laces above an ankle of the industrial shoe. The canopy portion is configured to cover the laces of the industrial shoe below the ankle of the industrial shoe when the industrial shoe protector is secured to the industrial shoe.

The industrial shoe protector presents numerous advantages, including: (1) tongue feature adds ability to hold more securely and be adjustable to different shoe sizes; (2) slits hold protector squarely on the shoe during use; (3) protects not only laces but top of shoe stitching from sparks and molten lead; (4) extends life of working shoes in heavy industrial atmosphere; (5) weighs very little and is not noticeably addition to the user; (6) easy to roll up and store; (7) can be made cheaply and easily; (8) works with a large variety of heavy industrial shoe wear.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

REFERENCE NUMBERS USED IN DRAWINGS

Figure 1:
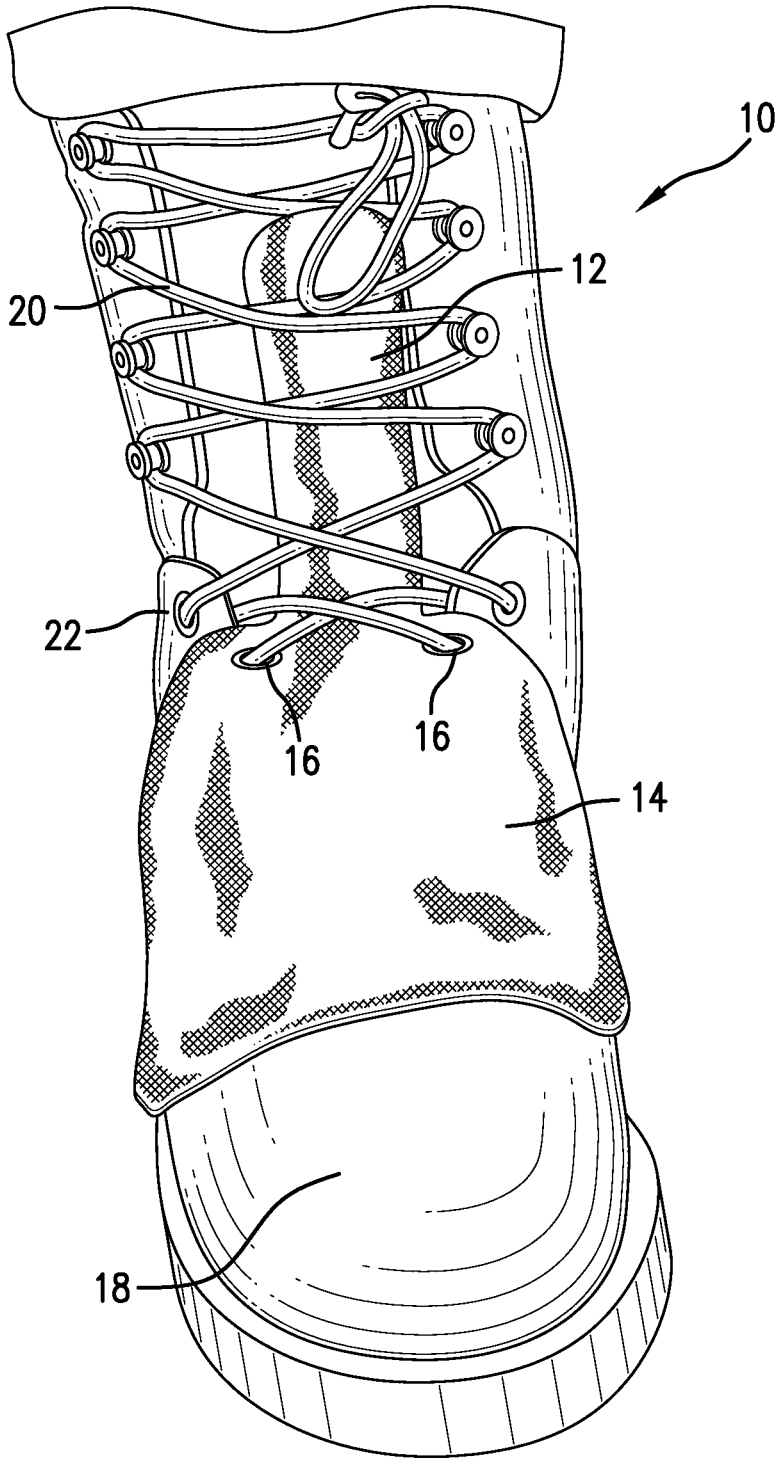
FIG. 1 shows an embodiment of an industrial shoe protector.

Turning now descriptively to the drawings, in which similar reference characters denote similar elements throughout the several views, the figures illustrate applicants' bottle dryer. With regard to the reference numerals used, the following numbering is used throughout the various drawing figures:

10 industrial shoe protector
12 tongue portion
14 canopy portion
16 slits
18 industrial shoe
20 laces
22 ankle

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 2:
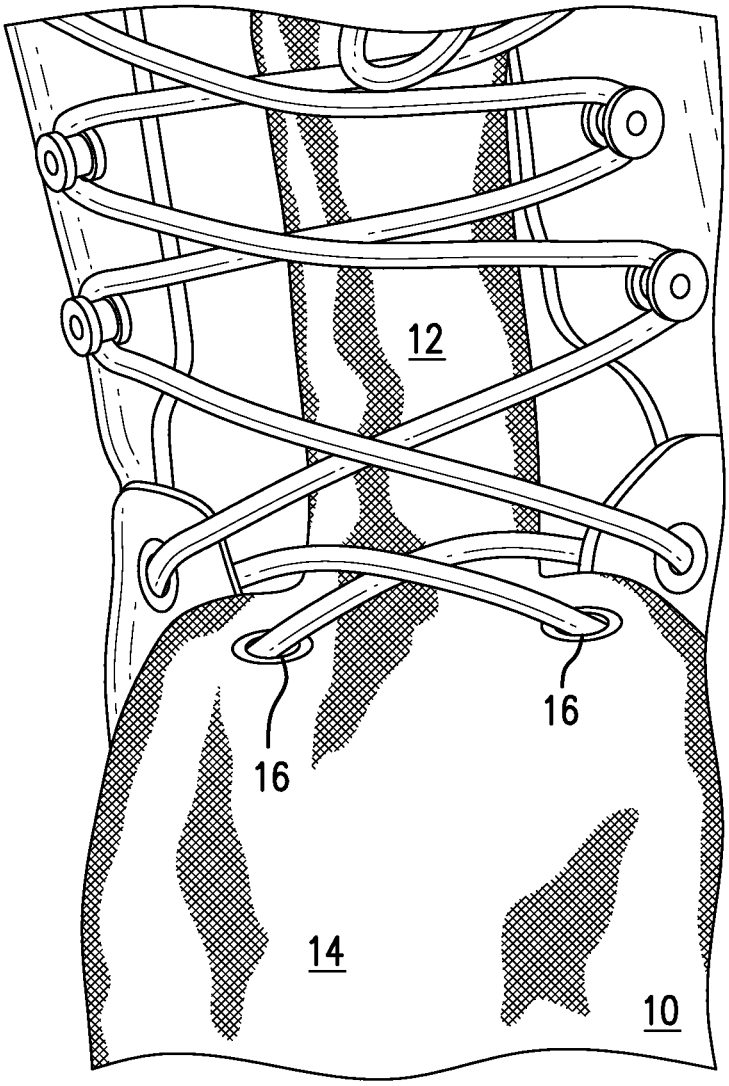
FIG. 2 shows another view of the embodiment of FIG. 1.
Figure 3:
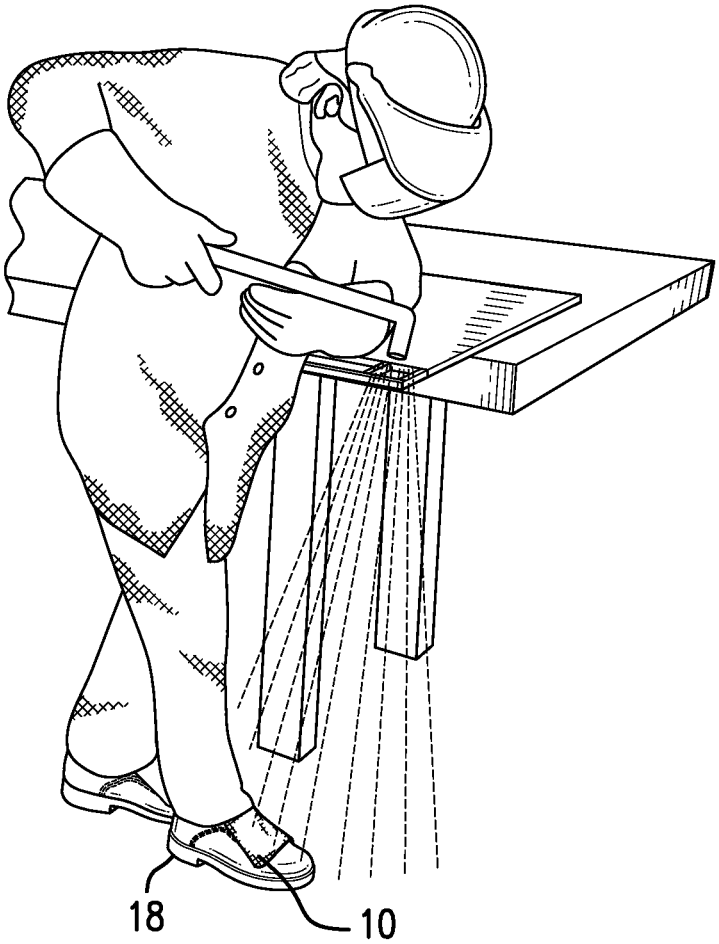
FIG. 3 shows an industrial shoe protector in use.
Figure 4:
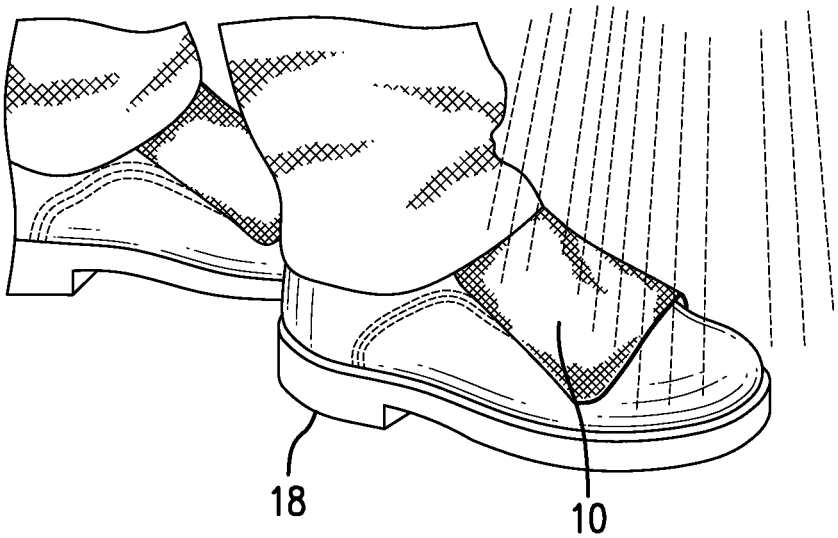
FIG. 4 shows another view of an industrial shoe protector in use.

FIGS. 1-4, shown an industrial shoe protector 10 configured secure to an existing industrial shoe 18, protecting laces 20 and stitching of the industrial shoe 18 from caused by welding, high speed cutting and other similar activities. The industrial shoe protector 10 includes a tongue portion 12, and a canopy portion 14 connected to the tongue portion 12. The canopy portion 14 has two slits 16. The industrial shoe protector 10 is configured to secure to the industrial shoe 18 by inserting the laces 20 of the industrial shoe 18 through the slits 16 in the canopy portion 14 with the tongue portion 12 deposed behind the laces 20 above an ankle 22 of the industrial shoe 18. The canopy portion 14 is configured to cover the laces 20 of the industrial shoe 18 below the ankle 22 of the industrial shoe 18 when the industrial shoe protector 10 is secured to the industrial shoe 18.

The industrial shoe protector 10 can be made of leather or other suitable material.

The canopy portion 14 tapers from a far end to an end connected to the tongue portion 12. In one embodiment, the canopy portion 14 is eight (8) inches long and tapers at one end from 5½ inches wide to the other end at 4½ inches wide.

The tongue portion 12 is narrow enough to fit inside the laces 20 above the ankle 22 of the industrial shoe 18. In one embodiment, the tongue portion 12 is 4 inches long by 1¼ inches wide.

The canopy portion 14 is preferably leather, 8 inches long, and tapering from a wider side at 5½ inches wide to a narrower side at 4½" wide. The narrower side of the canopy portion 14 is provided with two slits ¼" to ⅜" long, each position ¾" from center near the edge on the narrower side. The tongue portion 12 is preferably 4 inches long and 1¼ inches wide attached to said canopy portion 14 on said narrower side. The canopy portion 14 is preferably ten percent (10%) longer on the inside edge than the outside edge, to aid in preventing the canopy portion 14 from folding over. Depending on the size of the shoe to be protected, those of ordinary skill in the art will know that the difference in lengths of inside edge from outside edge can be adjusted without undue experimentation.

A Snap Rivet portion can further be provided. Snap portion is preferably a leather flap attachable to said canopy portion 14, attaching the side of said canopy portion 14 opposite the side to which the tongue portion 12 attaches. Snap portion leather flap will have a rivet snaps such that the flap can go around a lace and snap to a snap housing, further securing said canopy portion 14 to the laces of the shoe to be protected. Snaps can be alternatively placed both on the snap portion and the edge of said canopy portion 14 so the leather flap can go around a lace and snap to a snap housing on the edge of said canopy portion 14.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

What is claimed is:

1. An industrial shoe protector, comprising:

a tongue portion with an upper portion and a lower portion;

a canopy portion with an outside edge connected to a lower edge by a lower outside corner, and the lower edge connected to an inside edge by a lower inside corner, an upper inside corner connected to an upper inside edge, and an upper outside corner connected to an upper outside edge, wherein the upper inside corner and the upper outside corner directly merge into the lower portion of said tongue portion, wherein the canopy portion has a canopy portion upper quarter that is a quarter of the canopy portion that is closest to the tongue portion, wherein the inside edge is longer than the outside edge;

a first securing hole in the canopy portion upper quarter positioned laterally from a second securing hole in the canopy portion upper quarter;

wherein the industrial shoe protector is configured to secure to an industrial shoe by inserting one or more laces of the industrial shoe through the securing holes in the canopy portion with the upper portion of the tongue portion disposed above an ankle of the industrial shoe, behind the laces and between the laces and a tongue of the industrial shoe; and wherein said canopy portion is configured to cover the laces of the industrial shoe below the ankle of the industrial shoe when the industrial shoe protector is secured to the industrial shoe.

2. The industrial shoe protector of claim 1, wherein said industrial shoe protector is leather.

3. The industrial shoe protector of claim 1, wherein a width of said canopy portion tapers from the lower edge to the canopy portion upper quarter.

4. The industrial shoe protector of claim 1, wherein the tongue portion is less than three quarters of a width of the canopy portion.

5. The industrial shoe protector of claim 1, wherein said tongue portion extends at least 4 inches above the canopy portion.

6. The industrial shoe protector of claim 1, wherein said canopy portion is configured to cover top of shoe stitching on the industrial shoe forward of the ankle when the industrial shoe protector is secured to the industrial shoe.

7. The industrial shoe protector of claim 1, wherein said canopy portion is configured to completely cover the laces of the industrial shoe forward of the securing holes when the industrial shoe protector is secured to the industrial shoe.

8. An industrial shoe protector system, comprising:

an industrial shoe;

an industrial shoe protector comprising a tongue portion with an upper portion and a lower portion, a canopy portion with an outside edge connected to a lower edge by a lower outside corner, and the lower edge connected to an inside edge by a lower inside corner, an upper inside corner connected to an upper inside edge, and an upper outside corner connected to an upper outside edge, wherein the upper inside corner and the upper outside corner directly merge into the lower portion of said tongue portion, wherein the canopy portion has a canopy portion upper quarter that is a quarter of the canopy portion that is closest to the tongue portion and two securing holes in the canopy portion upper quarter, wherein the inside edge is longer than the outside edge;

wherein the industrial shoe protector is secured to the industrial shoe with one or more laces of the industrial shoe passing through the securing holes in the canopy portion with the upper portion of the tongue portion held by the laces against a tongue of the industrial shoe above an ankle of the industrial shoe;

wherein said canopy portion is configured to cover the laces of the industrial shoe forward of the securing holes towards a toe of the industrial shoe when the industrial shoe protector is secured to the industrial shoe.

9. The industrial shoe protector system of claim 8, wherein said canopy portion is configured to completely cover the laces of the industrial shoe forward of the securing holes when the industrial shoe protector is secured to the industrial shoe.

10. The industrial shoe protector system of claim 8, wherein the tongue portion is less than three quarters of a width of the canopy portion.

11. The industrial shoe protector system of claim 8, wherein a width of said canopy portion tapers from the lower edge to the canopy portion upper quarter.

12. An industrial shoe protector, comprising:

a tongue;

a canopy with four corners connected by three edges including a lower edge, an outside edge and an inside edge, the tongue extending from the canopy, wherein the canopy has a canopy portion upper quarter that is a quarter of the canopy that is closest to the tongue, wherein the inside edge of the canopy is longer than the outside edge;

a first securing hole in the canopy portion upper quarter positioned laterally from a second securing hole in the canopy portion upper quarter; and wherein said canopy is configured to cover laces of an industrial shoe below an ankle of the industrial shoe when the industrial shoe protector is secured to the industrial shoe.

13. The industrial shoe protector of claim 12, wherein the industrial shoe protector is configured to secure to an industrial shoe by inserting one or more laces of the industrial shoe through the securing holes in the canopy with the tongue extending above the ankle of the industrial shoe and between the laces and a tongue of the industrial shoe.

14. The industrial shoe protector of claim 12, wherein the tongue and the canopy are of a single unitary construction from a single continuous piece.

15. The industrial shoe protector of claim 12, wherein the inside edge of the canopy is 10% longer than the outside edge.

16. The industrial shoe protector of claim 12, wherein the four corners include an upper outside corner, a lower outside corner, a lower inside corner, and an upper inside corner; wherein the outside edge connected to the lower edge by the lower outside corner, and the lower edge connected to the inside edge by the lower inside corner; and wherein the upper inside corner and the upper outside corner directly merge into a lower portion of the tongue.

* * * * *